US006974610B1

(12) United States Patent
Koppes

(10) Patent No.: US 6,974,610 B1
(45) Date of Patent: Dec. 13, 2005

(54) GRAPHIC TRANSFER FOR HIGH VISIBILITY SAFETY APPAREL

(75) Inventor: Robert D. Koppes, Woodbury, MN (US)

(73) Assignee: Safe Reflections, Inc., St. Paul, MN (US)

( * ) Notice: Subject to any disclaimer, the term of this patent is extended or adjusted under 35 U.S.C. 154(b) by 0 days.

(21) Appl. No.: 11/009,102

(22) Filed: Dec. 10, 2004

Related U.S. Application Data

(63) Continuation-in-part of application No. 10/360,371, filed on Feb. 6, 2003, now Pat. No. 6,859,941.

(60) Provisional application No. 60/356,704, filed on Feb. 13, 2002.

(51) Int. Cl.[7] ..... B41M 5/40
(52) U.S. Cl. ..... 428/32.71; 428/32.77; 428/32.79; 428/32.81; 428/913; 428/914
(58) Field of Search ..... 428/32.71, 32.77, 428/32.79, 32.81, 913, 914, 40.1

(56) References Cited

U.S. PATENT DOCUMENTS 5,344,705 A * 9/1994 Olsen ..... 428/32.71
5,702,846 A * 12/1997 Sato et al. ..... 430/2
5,837,347 A * 11/1998 Marecki ..... 428/143
5,910,858 A * 6/1999 Frey et al. ..... 359/534
5,959,774 A * 9/1999 Benson et al. ..... 359/530
6,048,611 A * 4/2000 Lu et al. ..... 428/355 AC
6,416,856 B1 * 7/2002 Crandall ..... 428/325
2004/0197670 A1 * 10/2004 Takeyama ..... 430/1

* cited by examiner

*Primary Examiner*—B. Shewareged
(74) *Attorney, Agent, or Firm*—Gray, Plant, Mooty, Mooty & Bennett, P.A.; Robert W. Gutenkauf

(57) ABSTRACT

A roll stock of a graphic transfer strip for use in making a high visibility safety garment for wearing by an individual exposed to a higher than normal risk of injury from vehicular traffic. The safety garment complies with the visibility requirements of a published standard such as the American National Standards Institute for High Visibility Safety Apparel. The safety garment has one or more high visibility safety stripes that encircle the torso. The safety stripe is formed of a plurality of separate but closely spaced stripe segments in a generally repetitive pattern that is substantially continuous for the length of the stripe. The stripe segments are formed of a retroreflective material. The stripe segments occupy a portion of the total area of the stripe sufficient to impart to the stripe a coefficient of retroreflectivity that meets or exceeds that required by the standard being addressed for the safety garment.

18 Claims, 5 Drawing Sheets

10
11
18
19
22
21
27
12
25
24
10
15
14
15a
14a 32
30
29
29
24
4
33
4
30

29
30
29
12

GRAPHIC TRANSFER FOR HIGH VISIBILITY SAFETY APPAREL

CROSS REFERENCE TO A RELATED APPLICATION

This application is a continuation-in-part of U.S. application Ser. No. 10/360,371 filed Feb. 6, 2003 now U.S. Pat. No. 6,859,941 titled HIGH VISIBILITY SAFETY APPAREL AND GRAPHIC TRANSFER THEREFOR which application claims the benefit of U.S. Provisional Patent Application Ser. No. 60/356,704 filed Feb. 13, 2002.

TECHNICAL FIELD

The invention pertains to a graphic transfer for the manufacture of high visibility safety apparel worn by persons engaged in work activity such as road repair where they are subject to a higher than normal risk of injury from vehicular traffic.

BACKGROUND OF THE INVENTION

Pedestrians or others subject to traffic hazards typically wear one or more high visibility items of apparel. This includes, for example, signalmen standing watch along the side of a road, persons engaged in road construction or maintenance, emergency vehicle personnel, survey crews, law enforcement personnel, and a host of others. This group of individuals is in need of protection from inherent traffic hazards of low visibility regardless of the time of day. These hazards are intensified by the often complex and varying backgrounds found in many occupations subjecting the person to traffic, especially those involving all modes of traffic control, construction, equipment operation and vehicle roadway traffic. The major issue involves situations in which objects are visible but are not consciously recognized by the vehicle operator within sufficient time to take corrective action to avoid an accident.

Various standards have been proposed and adopted addressing the need for high visibility safety apparel to be worn by persons subject to vehicular hazard. For example, various states have adopted standards for safety apparel to be worn by maintenance workers on state highways. Various countries can have their own standards. Such standards typically dictate minimum coverage area and placement of highly reflective material on safety apparel to be worn by the persons subject to the traffic hazards.

Particularly prominent among these standards in the United States are those adopted by the American National Standards Institute which have been published by the Safety Equipment Association in publication ANSI/ISEA 107-1999 entitled *American National Standard for High-Visibility Safety Apparel*, incorporated herein by reference (the "ANSI Standard"). The ANSI Standard dictates performance requirements for high visibility safety apparel, capable of signaling a user's presence in a conspicuously visible manner under any light conditions by day and under illumination by vehicle headlights in the dark.

Examples of such safety apparel garments are vests, tee shirts, ponchos and waistcoats. The ANSI Standard contemplates that the garment has a background material that is a highly conspicuous colored fluorescent material. This background material will frequently comprise the garment body. The ANSI Standard further contemplates that a retroreflective material be attached to the garment and used in conjunction with the background material. A retroreflective material is one having the ability to return a substantial portion of incident light in the direction of origination of the light.

The ANSI Standard specifies three classes of high visibility safety apparel, according to the intended use of the garment, progressing from class one which is the most lenient, to class three. Class one, for example, includes garments to be worn by delivery vehicle drivers; class two, emergency response personnel; and class three, roadway construction personnel exposed to traffic exceeding 50 mph. For each class, there is specified for the garment a minimum surface area of background material, and a minimum surface area on the garment of retroreflective material. The current requirements are shown below:

| Class: | 1 | 2 | 3 |
|---|---|---|---|
| Background material exposed (square inches) | 217 | 775 | 1240 |
| Retroreflective material exposed (square inches) | 155 | 201 | 310 |

For all classes, the Standard requires that torso covering garments have a contiguous area of retroreflective material encircling the torso placed in such a manner to provide 360° visibility of the wearer. This is commonly interpreted to refer to a horizontal band or stripe encircling the torso having a minimum width of 50 mm for a class 3 garment, and 35 mm for a class two garment. A similar requirement applies to sleeves and trouser legs.

In addition, the ANSI Standard has a specification for the photometric performance of the retroreflective material. This is a measure of the efficiency of the retroreflective material in returning light to its source. It is expressed in terms of a coefficient of retroreflection (R).

The conventional approach to providing safety apparel with adequate visibility both before and after ANSI Standard's inception, and continuing to be used to meet the ANSI Standard, is to apply a continuous solid stripe of retroreflective material to the garment. Such a continuous stripe imparts an undesirable measure of rigidity to the garment. The retroreflective material does not bend as readily as the underlying fabric. This gives the garment a stiff look and feel. A solid stripe impedes heat loss from the body of the wearer of the garment. This is a comfort consideration in warm weather.

SUMMARY OF THE INVENTION

According to the present invention there is provided such a high visibility safety garment for wearing by an individual exposed to hazardous vehicular traffic which is constructed to comply with criteria of selected published and acknowledged standards with respect to the visibility and reflectivity of the entire garment ensemble, for example the ANSI Standard for a class 1, 2 or 3 garment. The garment can be a vest, jacket, bib, tee shirt or such other garment. The garment includes a garment base that has a background material that is a high visibility fabric such as a highly conspicuous colored fluorescent material. The garment has one or more highly visible safety stripes fixed on the base extending around the base positioned to horizontally encircle the torso of an individual when wearing the garment. The garment can also have stripes with vertical components that extend over the shoulders of the individual.

The invention includes such a garment having one or more reflective stripes or band images that are formed of disconnected but closely spaced retroreflective material segments whereby the composite stripe image complies with the current or revised ANSI/ISEA 107-1999 Standard or with such other current standard being addressed.

The safety stripe has a width defined between parallel top and bottom boarders that are coextensive with the length of the stripe and define a stripe area. The stripe is formed of a plurality of separate but closely spaced stripe segments in a generally repetitive pattern continuous for the length of the stripe. The stripe segments are formed of a retroreflective material that has a retroreflective coefficient or index value ($R_A$). The exposed area encompassed by the stripes is equal to at least the minimum value dictated by the ANSI Standard or such other standard being addressed.

The stripe consisting of the combined retroreflective segment and non-segment areas has a composite retroreflectivity index ($R_B$) that is less than that of the retroreflective material alone ($R_A$). The reduction relationship is linear. For example, if the retroreflective segment area of the stripe constitutes 50% of the total stripe area, the retroreflectivity of the stripe will be 50% of that of the retroreflective material, or $R_B = R_A/2$. The value of $R_B$ purposefully meets the minimum retroreflectivity criteria for the ANSI Standard or such other standard being addressed. This effectively dictates the minimum coverage requirement of the surface area covered by the retroreflective segments compared to the total surface area of the stripe.

Put another way, by design the ratio of the surface area of the stripe segments to the total stripe area is made to be high enough so that when multiplied by the retroreflective index of the segment material, the resultant index complies with that of the standard being addressed.

The stripe of disconnected but closely spaced stripe segments resembles the traditional continuous stripe usually found on high visibility safety apparel. The approaching observer recognizes the garment as an item of high visibility safety apparel of the type commonly worn by road construction workers or others, and reacts accordingly as by slowing down or driving with increased vigilance.

The invention also includes a graphic transfer device for the fabrication of high visibility safety garments according to the invention. The graphic transfer device carries the disconnected segment stripe image on it for transfer to the safety garment.

The invention also includes a graphic transfer roll stock having a continuous graphic transfer strip so that only graphic transfer sections as needed can be removed from the strip.

The discontinuous safety stripe is less rigid or stiff as compared to a continuous stripe of material. The garment has greater flexibility with more supple feel. The fabric more easily bends resulting in a better fit. The spacing between the retroreflective material segments permits the escape of heat from the body of the wearer. The disconnected segments can be formed in an attractive design. Indicia such as corporate identification, a company logo, a fanciful design or the like can be included. The segments can be diagonal bars in a hash-mark style of design; chevrons; spherical or elliptical arcs; or other designs.

IN THE DRAWINGS

DESCRIPTION OF PREFERRED EMBODIMENTS

Figure 1:
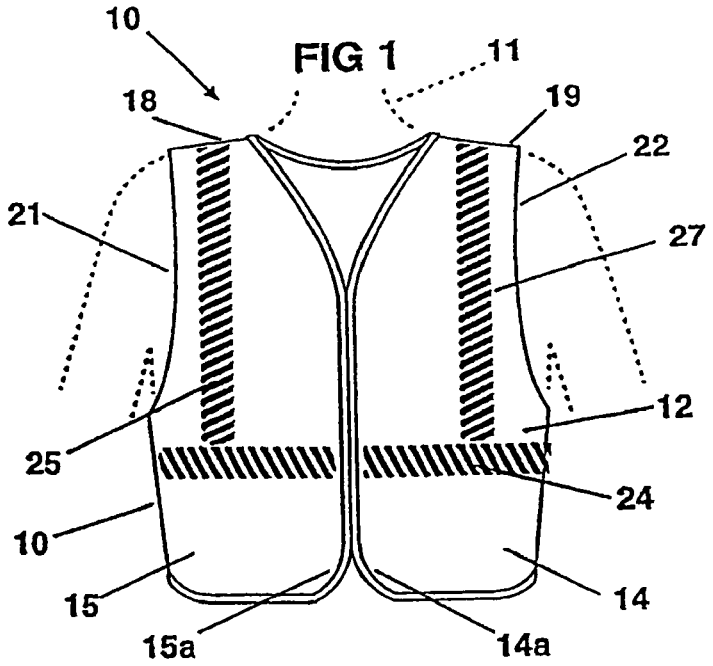
FIG. 1 is a front elevational view of a high visibility safety garment according to the invention with portions of a user shown in phantom lines.
Figure 2:
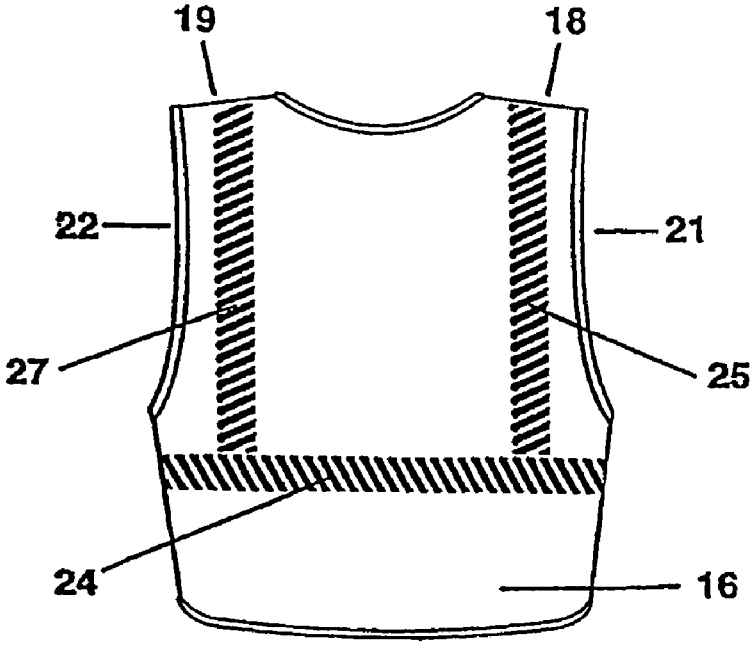
FIG. 2 is a back view of the garment of FIG. 1.

Referring to the drawings, there is shown in FIGS. 1 and 2 a high visibility safety garment indicated generally at 10 being worn by an individual indicated in phantom at 11 in FIG. 1. The garment 10 shown is configured as a vest although the particular type of garment is not critical to the invention. The garment could be a jacket, tee shirt, bib, poncho, coverall or other such apparel item commonly worn as a safety garment having suitable safety markings.

Vest 10 has a base 12 that is formed at least partially of a suitable background material. The background material is typically a colored fluorescent material that is highly conspicuous and emits optical radiation at wavelengths longer than those absorbed. Fluorescent material enhances daytime visibility, especially and dawn and dusk, and is usually red, red-orange or lime-yellow in color.

Base 12 has the usual vest configuration with front panels 14, 15 that come together at front edges 14*a*, 15*a*, and are connected to a back section 16. Front edges 14*a*, 15*a* can have suitable means for fastening them together. Shoulders 18, 19 extend over the shoulders of the individual 11. The sides of vest 10 have arm openings 21, 22.

Vest 10 has a plurality of high visibility safety stripes. A first safety stripe is comprised as a horizontal safety stripe 24 attached to base 12 and extending horizontally around it so as to horizontally encircle the torso of the wearer and be visible 360° about the wearer of the garment. Horizontal safety stripe 24 is located toward but spaced above the lower edge of base 12.

Vest 10 has second and third safety stripes 25, 27 that are generally vertical and extend from the front panels 14, 15 on base 12, over shoulders 18, 19 to the back section 16.

Figure 3:
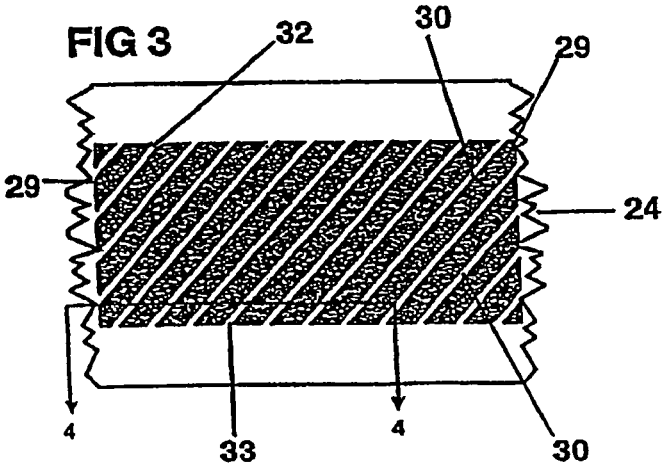
FIG. 3 is an enlarged view of a portion of the safety stripe of retroreflective material on the garment of FIG. 1.
Figure 4:
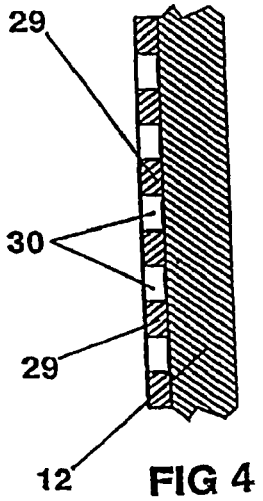
FIG. 4 is an enlarged sectional view of a portion of the safety stripe shown in FIG. 3 taken along the line 4—4 thereof.

An enlarged section of the horizontal stripe 24 is shown in FIG. 3, and also in FIG. 4. As can be seen in FIG. 3, stripe 24 is comprised of a plurality of stripe segments 29 that are disconnected from one another but closely spaced. The stripe segments 29 are separated by non-segment gaps or spaces 30. Stripe 24 has a top edge boarder 32 and a bottom edge boarder 33. Boarders 32, 33 define the stripe area. Segments 29 and spaces 30 are confined between the boarders 32, 33.

The segments 29 are closed geometric figures arranged in a repeating segment-space pattern. In the example of FIGS. 1 through 4, the segments are parallelograms. The pattern is one of parallel, spaced apart parallelograms in a pattern sometimes known as a hash mark pattern. The segments are spaced apart by the spaces 30. In this example the segments are completely disconnected. The spaces 30 are open at the top and bottom boarders 32, 33.

The segments 29 are formed of retroreflective material. Retroreflection, as opposed to mirror reflection or diffuse reflection, occurs when a high percentage of radiant energy is returned back in the direction from which it came, and over a wide variety of angles from which the material is being struck. A retroreflective material has the property to reflect light directly back to the light source through a wide range of entrance angles. In particular, it will reflect a vehicle headlight back to the vehicle. An example of a retroreflective material is shown in U.S. Pat. No. 6,110,558 issued Aug. 29, 2000 and incorporated herein by reference. The efficiency of a retroreflective material in returning light to its source is indicated by its coefficient of retroreflectivity. The coefficient of retroreflectivity is referred to herein as "R".

Stripe segments 29 serve to reflect light from vehicle headlights back to the vehicle to alert the vehicle driver as to the presence of the work person. Stripe segments 29 can be bonded, glued, sewn or otherwise suitably fastened to the base 12. The retroreflective material of stripe segments 29 has a coefficient or retroreflection indicated herein as "$R_A$."

Vest 10 is constructed to comply with visibility standards according to the current ANSI Standard. Vest 10 could as well be constructed according to some other acknowledged and accepted set of visibility standards for high visibility safety garments. An example of such standards is the ANSI Standard referenced above, and within that standard, the criteria for class 3 garments. There can be other such standards such as international standards, European standards or revised ANSI standards. An example is European standard EN471. The various standards are performance standards that are subject to revision from time to time. The invention as described herein is not limited to addressing currently existing standards, but standards as may be revised in the future.

The standard to be addressed will specify a minimum surface area of background material, which will be represented as "$B_{min}$." The standard will typically have a criteria of a minimum surface area of high visibility safety stripe or stripes. This will be referenced herein as "$A_{min}$." The standard will typically specify a minimum coefficient of retroreflectivity for the safety stripe. This will be referenced herein as "$R_{min}$." For example the current ANSI Standard for a class 3 garment specifies a minimum area of background material of $B_{min}$=1240 square inches; safety stripe area $A_{min}$=310 square inches; and photometric performance $R_{min}$ which varies according to the observation angle and entrance angle of the light.

The current ANSI Standard for a class 2 garment specifies $B_{min}$=775 square inches; and $A_{min}$=201 square inches. For both class 1 and 2 garments $R_{min}$ is specified by Tables 5 and 6 of the publication *American National Standard for High-Visibility Safety Apparel*, ANSI/ISEA 107-1999 published by The Safety Equipment Association and approved Jun. 1, 1999 by the American National Standards Institute, Inc., which tables are incorporated herein by reference.

The standard can also specify the minimum width of the safety stripes and the minimum distance of the lowest horizontal safety stripe from the lower edge of the garment. For example, with respect to the current ANSI Standard, the minimum stripe width is 50 mm for a class 3 garment and 35 mm for class 2 garment. The minimum distance of the lowest safety stripe from the lower edge of the garment is 50 mm.

Criteria specified by the various standards can vary from one standard to another and are subject to revision. For example the current ANSI/ISEA 107-1999 is expected to be revised shortly to ANSI/ISEA 107-2003 and is subject to revision after that (collectively called the ANSI/ISEA 107 Standard herein). For this reason the criteria recited herein are expressed symbolically.

Base 12 of vest 10 has a surface area of background material. The amount of this surface area is referenced herein as "$B_{bk}$." Vest 10 has a surface area of background material such that $B_{bk}$ is equal to or greater than $B_{min}$. (Symbolically expressed as $B_{bk} \geqq B_{min}$). The safety stripes of vest 10 have a surface area "$A_{stripe}$" such that $A_{stripe}$ is equal to or greater that $A_{min}$. (Symbolically expressed as $A_{stripe} \geqq A_{min}$). The stripe has a coefficient of retroreflection "$R_B$" which is a composite of the stripe segments and the spaces. The stripe segments and spaces are deliberately sized and spaced such that the composite or resultant coefficient of retroreflectivity $R_B$ for the safety stripe is equal to or greater than $R_{min}$. (Symbolically stated, $R_B \geqq R_{min}$).

The surface area of the safety stripe $A_{stripe}$ is calculated as the product of the width of the stripe (the distance between the top and bottom boarders 32, 33) and the length of the stripe. The stripe area consists of the area of the segments, "$A_{seg}$" and the area of the spaces, "$A_{space}$." The coefficient of retroreflectivity $R_A$ of the segment material is by design somewhat higher than the standard minimum $R_{min}$. There is a linear relationship between the surface area of the stripe occupied by the segment material and the composite retroreflectivity coefficient of the stripe. The relationship is $R_{stripe}=R_A \times (A_{seg}/A_{stripe})$. For example if the segments 29 occupy 75% of the stripe area, and the spaces occupy the other 25%, then the composite coefficient of retroreflectivity $R_{stripe}$ is 75% of the coefficient of retroreflectivity of the segment material alone. The value of $A_{seg}$ can be decreased to the point where $R_{stripe}=R_{min}$. In order to meet the criteria of the standard being addressed, the safety stripes of vest 10 have a segment area $A_{seg}$ such that $R_{stripe} \geqq R_{min}$. This enables a maximization of the space area of the stripe.

By way of more specific example, Table 5 of the ISEA document American National Standard for High-Visibility Safety Apparel (ANSI/ISEA 107-1999) shows a minimum required value of a coefficient of retroreflectivity $R_{min}$=300 (measured in units of candelas per lux per square meter). A stripe material can have, by way of example, a coefficient of retroreflectivity value of $R_A$=580. The ratio of $R_{min}$ to $R_A$ is 0.52 indicating that at least 52% of the stripe area must be occupied by the retroreflective material thereby permitting up to 48% of the stripe area to be occupied by the spaces in order to be in compliance with the standard.

The spacing between the segments increases the flexibility of the garment and adds to the supple feel of the garment. It enables greater heat loss through the garment. It also enables a more attractive design of the garment. The permitted area between retroreflective segments of the safety stripe is limited by the relationship $R_{seg} \geqq R_{min}$.

Figure 5:
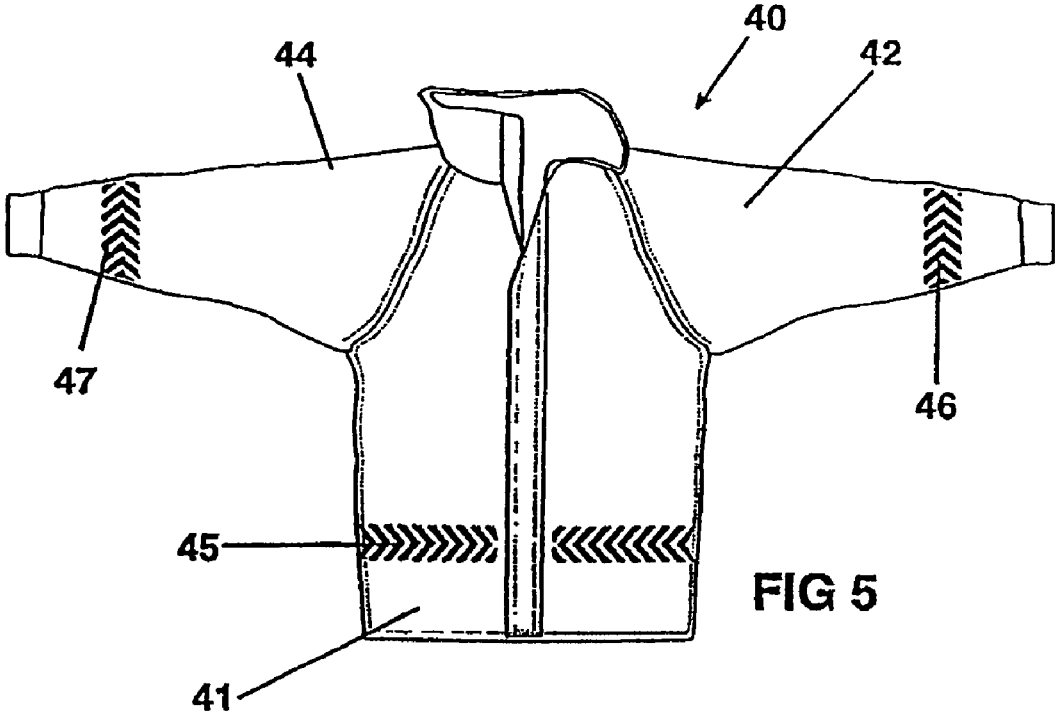
FIG. 5 is a front elevational view of another variety of high visibility safety garment according to the present invention.

FIG. 5 shows an alternative embodiment of a high visibility safety garment 40 configured as a jacket having a body 41 and sleeves 42, 44. A high visibility safety stripe 45 is affixed to the garment positioned to extend around the torso. Additional high visibility safety stripes 46, 47 extend around the sleeves and are positioned to be in alignment with the stripe 45 when the sleeves are dropped to the side of the jacket.

The garment is configured to comply with an acknowledged standard for such garments. It has a background material area of $B_{bk}$ which is equal to or greater than $B_{min}$. The safety stripe 45 has an area $A_{stripe}$ which is equal to or greater than $A_{min}$. The safety stripes are comprised of separate substantially disconnected stripe segments of a retroreflective material, separated by spaces. The area of the stripe that is occupied by the stripe segments is large enough to satisfy the relationship that $R_{stripe}$ is greater than or equal to $R_{min}$.

Figure 6:
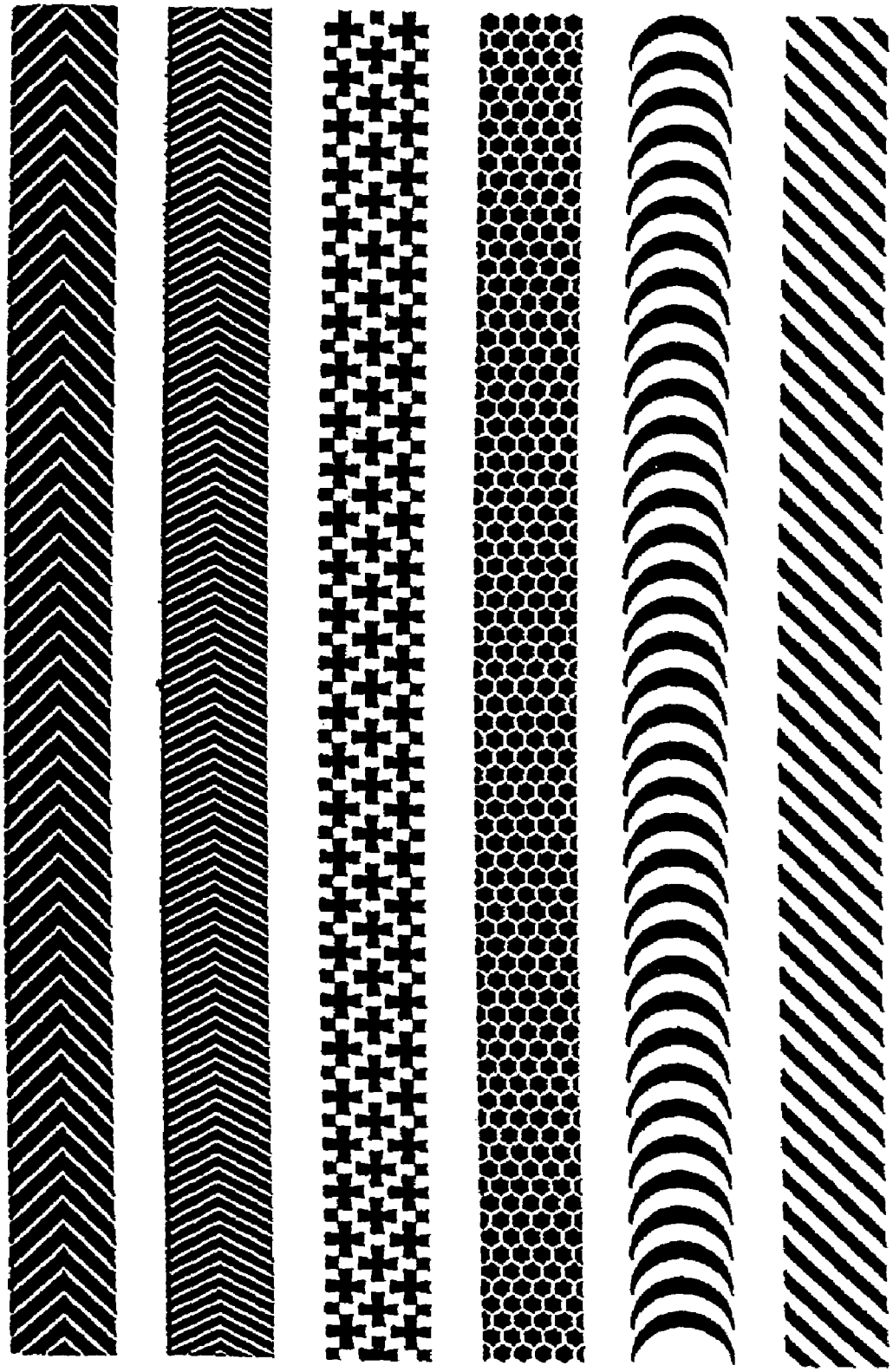
FIG. 6 shows a variety of different embodiments of designs of the retroreflective material safety stripe of high visibility safety garments according to the present invention.

FIG. 6 shows a variety of different configurations of stripe segments for safety stripes for use in connection with high visibility safety garments of the invention. From left to right in FIG. 6, the first two designs are segments of different chevron sizes. The next is a pattern of crosses. The following is a design of small, spaced apart pentagon figures. The next is a repeating pattern of arc segments. The last is a hash-mark pattern. In each of the examples spaces between the stripe segments are open between the stripe boarders. It may be seen that the segment pattern need riot necessarily be symmetrical. For example, a company logo could be imbedded in the design.

Figure 7:
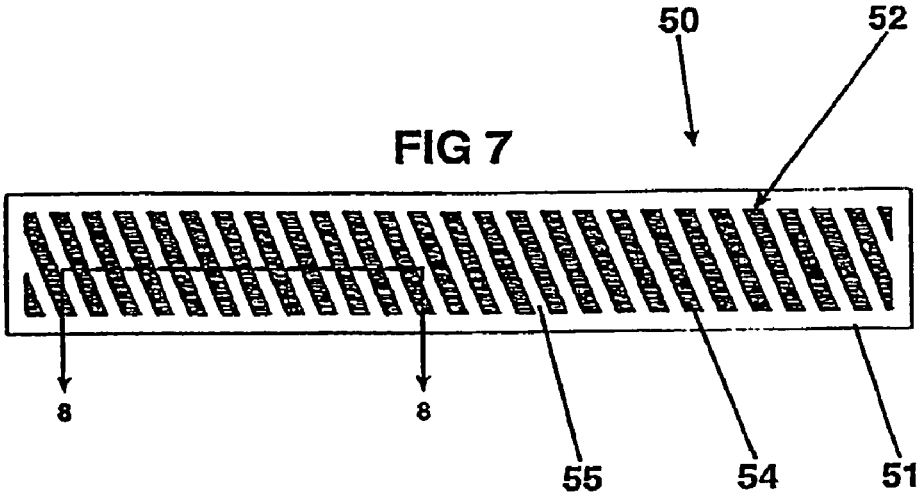
FIG. 7 is a top plan view of one embodiment of a graphic transfer device of the invention.
Figure 8:
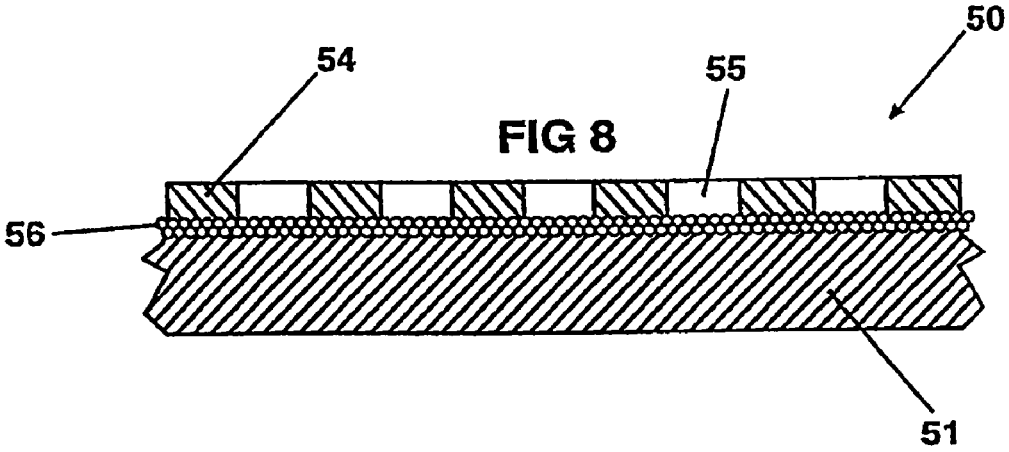
FIG. 8 is an enlarged sectional view of a portion of the graphic transfer device of FIG. 7 taken along the line 8—8 thereof.

FIGS. 7 and 8 show a graphic transfer device according to the invention for use in fabrication or construction of a high visibility safety garment as described herein that complies with the ANSI Standard or such other standard being addressed.

A graphic transfer device is indicated generally at 50 in FIGS. 7 and 8. Transfer device 50 has a backing 51 of sturdy paper or other equivalent material. A layer of retroreflective optical elements or beads 56 is adhered to one surface of the backing 51. See, for example, U.S. Pat. No. 6,153,128 issued Nov. 28, 2000 to Lightle et al. disclosing an example of such retroreflective beads.

Adhesive strips 54 are located on the surface of bead layer 56 opposite backing 51. Adhesive strips 54 can be heat activated. Adhesive strips 54 can have an adhesive formulated from polyvinyl chloride homopolymer resin, phthalate esters platicizer, fumed silica, trimethoxysilylpropyl silane, epoxy resin and copolyester in proportions, respectively, of 30-40, 30-40, 5-10, 2-4, and 10-20. Strips 54 are laid out in a pattern that corresponds to the intended safety stripe pattern of a finished high visibility safety garment. In the example shown, the adhesive strips are laid out in a diagonal hash-mark pattern.

FIG. 7 shows that adhesive strips 54 are separated by spaces 55 and form a stripe pattern 52. In use the transfer device 50 is placed against the fabric of the safety garment under construction with the adhesive strips contacting the fabric. Heat is applied to the transfer device to activate the adhesive. The adhesive sticks to the garment fabric and carries with it corresponding portions of bead layer 56. The remainder of bead layer 56 stays on backing 51 as waste product upon removal of the backing 51 from the fabric. The bead layer portion adhering to the fabric forms the retroreflective stripe pattern on the garment.

Referring again to FIG. 7, the area of the stripe pattern is the sum of the area of the adhesive strips and the area of the spaces between them. The bead material has a retroreflectivity coefficient of $R_A$. The adhesive strip occupies an area of the stripe pattern of $A_{adh}$. The stripe pattern has an area of $A_{pattern}$. The value of $A_{adh}$ is sufficiently large such that $R_A \times (A_{adh}/A_{pattern}) \geqq R_{min}$. In other words the ratio of the bead layer area that will transfer to the garment, to the total area of the stripe pattern being transferred, is large enough that the resultant coefficient of retroreflection will equal or exceed the minimum required by the standard.

Figure 9:
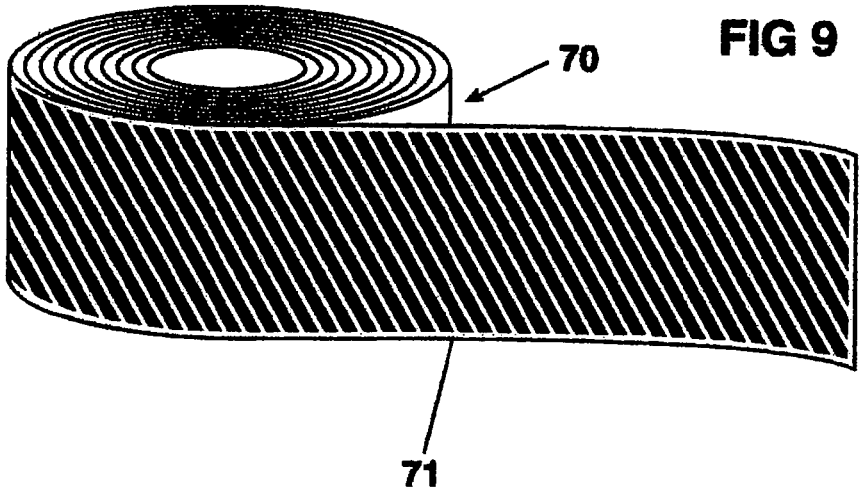
FIG. 9 is a view of graphic transfer roll stock according to the invention.

FIG. 9 shows an item of graphic transfer roll stock indicated generally at 70. Roll stock 70 comprises an elongate, rolled-up continuous graphic transfer strip 71. Roll stock 70 provides a compact and economical way of inventorying and shipping the graphic transfer. It also provides a convenient way to select only so much graphic transfer as is needed for a project. In addition the roll stock configuration lends itself to use in high output manufacturing processes.

Figure 10:
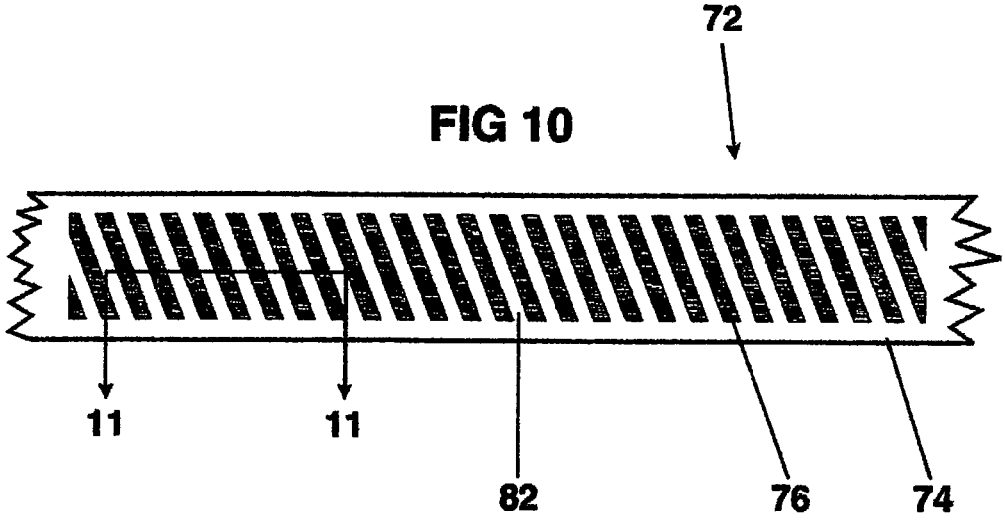
FIG. 10 is a plan view of a graphic transfer section of the roll stock of FIG. 10.
Figure 11:
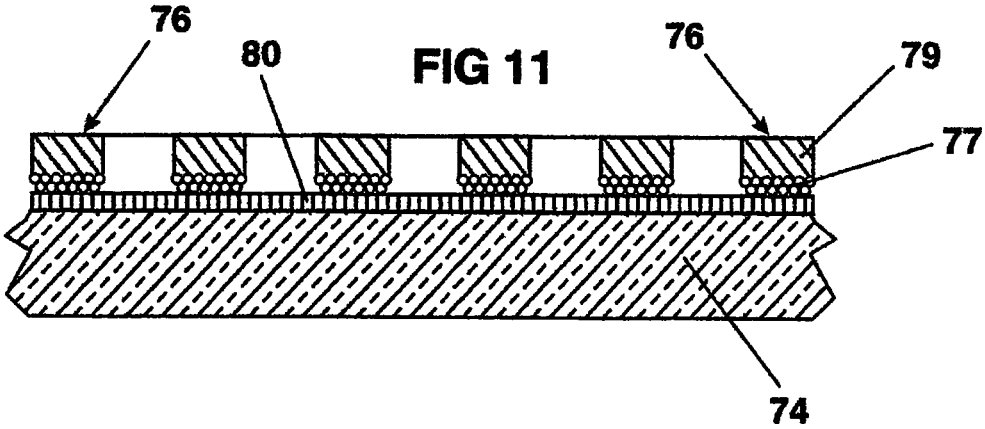
FIG. 11 is an enlarged sectional view of a portion of the graphic transfer section of FIG. 10 taken alone the line 11—11 thereof.

FIG. 10 shows a section 72 of graphic transfer taken from roll 70, also shown in sectional view in FIG. 11. The purpose of graphic transfer section 72 is for lamination to a recipient surface such as the fabric of a high visibility safety garment to make a safety stripe consisting of separate but closely spaced segments of retroreflective material giving the stripe a composite index of retroreflectivity that meets or exceeds a standard being addressed.

The graphic transfer section includes a backing or carrier 74. Carrier 74 can be, for example, a plastic or polyester material that is heat resistant up to approximately 500° F. for purposes enduring a laminating process. The carrier can be clear or translucent in order to improve placement accuracy during a laminating process. The carrier can have a thickness of 0.002 inches and a width of 2.125 inches.

A continuous pattern of disconnected but closely spaced graphic transfer segments 76 are adhered to carrier 74 along the length thereof. A graphic transfer segment 76 includes a layer of retroreflective material consisting of optical elements or beads 77 and a heat activated graphic transfer adhesive 79. The retroreflective material can be comprised of a film of wide-angle, exposed retroreflective lens glass beads having a typical coefficient of retroreflection of R=500. The graphic transfer adhesive 79 is fixed to the side of the bead layer 77 opposite the carrier 74.

The graphic transfer segments 76 are attached to the carrier 74 by a carrier adhesive 80 on the surface of carrier 74. The carrier adhesive 80 holds the graphic transfer segments to the carrier 74 until released during the laminating process to attach the graphic transfer segments to a recipient surface. The carrier adhesive is preferably one having a bond strength that does not increase over time and does not increase or decrease when subject to increased temperatures experienced during the laminating process. The bond strength should be sufficient to maintain product integrity during the manufacturing process, customer handling, and the lamination process up to the point of release from the carrier 74. The adhesive can be a silicone adhesive and can be clear or translucent for the purpose of placement accuracy during the laminating process.

The graphic transfer adhesive 79 of each graphic transfer strip is located so as to first come in contact with the recipient surface during the laminating process. The graphic transfer adhesive is heat activated. During a laminating process, the adhesive under the influence of heat and pressure will permanently attach to the recipient surface. The graphic transfer adhesive can be a polyester adhesive having a typical adhesion temperature of 300–350° F.

The graphic transfer segments 76 are arranged on the carrier 74 in patterns as previously described. As shown the graphic transfer segments 76 are arranged on the carrier 74 in a hash-mark pattern. The graphic transfer segments are separated by spaces 82. The composite retroreflectivity coefficient is determined by determining the ratio of the area of the section 72 occupied by the transfer segments 76 to the total area, and applying that ratio to the coefficient of retroreflection of the material of the graphic transfer segment. By design the composite coefficient of retroflection meets or exceeds that of a standard being addressed.

In terms of use, a graphic transfer section 72 is removed from the strip 71 of roll stock 70. Only the needed length of section is removed. The section is then laminated to a recipient surface such as the fabric of a high visibility safety garment. Lamination is accomplished according to usual and preferred processes, for example, using heat at 300–450° F., and pressure at 20–45 psi, for a suitable duration of time such as 15 to 35 seconds. In lamination the graphic transfer adhesive is heat actuated and adheres to the recipient surface. The carrier 74 is removed which leaves the optical surface 77 exposed.

What is claimed is:

1. A graphic transfer roll stock for use in fabrication of a high visibility safety garment constructed to comply with retroreflection standards of an acknowledged and recognized safety garment standard specifying a minimum coefficient of retroreflection for a stripe on a safety garment including a plurality of disconnected but closely spaced stripe segments to approximate a continuous stripe in appearance, said stripe segments formed of a retroreflective material having a coefficient of retroreflection higher than the minimum coefficient of retroreflection specified by the standard being addressed, comprising:

an elongate, rolled-up continuous graphic transfer strip;

said graphic transfer strip including an elongate flexible carrier;

a continuous pattern of disconnected but closely spaced graphic transfer segments adhered to the carrier along the length thereof;

each graphic transfer segment including a layer of retroreflective material with optical elements having a coefficient of retroreflection that is greater than the minimum coefficient of retroreflection specified by the standard being addressed, and a heat activated graphic transfer adhesive fixed to the retroreflective layer opposite the carrier for use in a lamination process to fix the retroreflective layer to a recipient surface;

a carrier adhesive releasably adhering the retroreflective layer to the carrier;

said graphic transfer segments located on said carrier forming a stripe pattern corresponding to the intended safety stripe pattern of disconnected but closely spaced stripe segments of a retroreflective material occupying a sufficient portion of the total stripe area such that when the ratio of the surface area occupied by the stripe segments to the total stripe area is multiplied by the retroreflection coefficient of the segment material, the result is at least equal to the minimum coefficient of retroreflection specified by the standard being addressed.

2. The graphic transfer roll stock of claim 1 wherein:

said carrier is clear.

3. The graphic transfer roll stock of claim 1 wherein:

said carrier is translucent.

4. The graphic transfer roll stock of claim 1 wherein:

said carrier is a plastic or polymer material that is heat resistant up to approximately 500° F.

5. The graphic transfer roll stock of claim 1 wherein:

the carrier adhesive has a bond strength that does not increase over time and does not increase or decrease when subject to increased temperatures experienced during a laminating process.

6. The graphic transfer roll stock of claim 1 wherein:

the carrier adhesive is clear.

7. The graphic transfer roll stock of claim 1 wherein:

the carrier adhesive is translucent.

8. The graphic transfer roll stock of claim 1 wherein:

the graphic transfer adhesive is a polyester adhesive having a typical adhesion temperature of approximately 300°–350° F.

9. The graphic transfer roll stock of claim 1 wherein:

the retroreflective material is a film of wide-angle, exposed retroreflective lens glass beads.

10. A graphic transfer strip for use in fabrication of a high visibility safety garment constructed to comply with retroreflection standards of an acknowledged and recognized safety garment standard specifying a minimum coefficient of retroreflection for a stripe on a safety garment including a plurality of disconnected but closely spaced stripe segments to approximate a continuous stripe in appearance, said stripe segments formed of a retroreflective material having a coefficient of retroreflection higher than the minimum coefficient of retroreflection specified by the standard being addressed, comprising:

a flexible carrier;

a continuous pattern of disconnected but closely spaced graphic transfer segments adhered to the carrier along the length thereof;

each graphic transfer segment including a layer of retroreflective material with optical elements having a coefficient of retroreflection that is greater than the minimum coefficient of retroreflection specified by the standard being addressed, and a heat activated graphic transfer adhesive fixed to the retroreflective layer opposite the carrier for use in a lamination process to fix the retroreflective layer to a recipient surface;

a carrier adhesive releasably adhering the retroreflective layer to the carrier;

said graphic transfer segments located on said carrier forming a stripe pattern corresponding to the intended safety stripe pattern of disconnected but closely spaced stripe segments of a retroreflective material occupying a sufficient portion of the total stripe area such that when the ratio of the surface area occupied by the stripe segments to the total stripe area is multiplied by the retroreflection coefficient of the segment material, the result is at least equal to the minimum coefficient of retroreflection specified by the standard being addressed.

11. The graphic transfer roll stock of claim 10 wherein:

said carrier is clear.

12. The graphic transfer roll stock of claim 10 wherein:

said carrier is translucent.

13. The graphic transfer roll stock of claim 10 wherein:

said carrier is a plastic or polymer material that is heat resistant up to approximately 500° F.

14. The graphic transfer roll stock of claim 10 wherein:

the carrier adhesive has a bond strength that does not increase over time and does not increase or decrease when subject to increased temperatures experienced during a laminating process.

15. The graphic transfer roll stock of claim 10 wherein:

the carrier adhesive is clear.

16. The graphic transfer roll stock of claim 10 wherein:

the carrier adhesive is translucent.

17. The graphic transfer roll stock of claim 10 wherein:

the graphic transfer adhesive is a polyester adhesive having a typical adhesion temperature of approximately 300°–350° F.

18. The graphic transfer roll stock of claim 10 wherein:

the retroreflective material is a film of wide-angle, exposed retroreflective lens glass beads.

* * * * *